United States Patent [19]

Servas et al.

[11] Patent Number: 4,540,287

[45] Date of Patent: Sep. 10, 1985

[54] ASPHALT RECYCLING

[75] Inventors: Vladimiros Servas; Wilhelm P. H. Voors, both of Pretoria, South Africa

[73] Assignee: South African Inventions Development Corp., Province, South Africa

[21] Appl. No.: 556,891

[22] Filed: Dec. 1, 1983

[30] Foreign Application Priority Data

Dec. 2, 1982 [ZA] South Africa ..... 82/8885

[51] Int. Cl.[3] ..... B28C 5/46

[52] U.S. Cl. ..... 366/7; 366/25

[58] Field of Search ..... 366/2, 7, 22, 23, 24, 366/25, 14; 106/281

[56] References Cited

U.S. PATENT DOCUMENTS

| | | | |
|---|---|---|---|
| 4,075,710 | 2/1978 | Jakob | 366/25 |
| 4,096,588 | 6/1978 | Mendenhall | 366/23 |
| 4,147,436 | 4/1979 | Garbelman | 366/25 |
| 4,318,619 | 3/1982 | Schlarmann | 366/7 |
| 4,332,478 | 6/1982 | Binz | 366/25 |

FOREIGN PATENT DOCUMENTS

| | | |
|---|---|---|
| 0033812 | 12/1980 | European Pat. Off. . |
| 1385812 | 3/1975 | United Kingdom . |
| 1507430 | 4/1978 | United Kingdom . |

*Primary Examiner*—Robert W. Jenkins

*Attorney, Agent, or Firm*—Bernard, Rothwell & Brown

[57] ABSTRACT

This invention provides a hot-mix asphalt recycling processes for reconstituting and upgrading old road materials. In usual hot-mix plants the asphaltic material is heated by a naked flame. Residual bitument in the asphalt is exposed to the naked flame from the burner, which can seriously damage the bitument and render it largely worthless. In order to reduce wastage, the invention provides for heating of aggregate in a heating zone, and supplying of the heated aggregate, usually cold reclaimed asphalt, and suitable binder material to a substantially flame-free mixing zone. By mixing these constituents in that zone, it is possible to produce a usable hot asphalt pavement mix with reduced asphalt wastage.

8 Claims, 5 Drawing Figures

ASPHALT RECYCLING

THIS INVENTION relates to a method and an apparatus for recycling old asphaltic pavement material (herein referred to as asphalt) which has been reclaimed from 'black top' road surfaces or other similar surfaces.

As a result of rises in the price of petroleum products and the emphasis being placed on saving energy, there has been an increasing interest in many countries in the salvaging and re-use of asphalt, including 'black top' road surfacing material in road maintenance and reconstruction. These processes, known generally as recycling, can take a number of forms, including a hot-mix type of process for reconstituting and upgrading old road materials.

In conventional hot-mix plants known to the Applicant, asphaltic material, stone and fine aggregate, such as sand, are subjected to direct contact with a naked flame from an oil burner in a horizontal rotating steel drum. In this heating process, residual bitumen in the asphalt is exposed to the naked flame from the burner, which can seriously damage the bitumen and render it largely worthless.

This wastage is clearly undesirable.

According to the present invention, there is therefore provided a method of recycling asphalt, which comprises heating aggregate in a heating zone, supplying the heated aggregate, reclaimed asphalt, and suitable binder material to a substantially flame-free mixing zone, and there mixing these constituents to produce a usable hot asphalt pavement mix.

The reclaimed asphalt may be reclaimed from any asphaltic pavement, and may be introduced into the mixing zone in a cold state. It may be broken up, for example milled, before it is introduced into the mixing zone.

The aggregate, which may be any previously unused or new aggregate, may be heated in the heating zone to a suitably high temperature to provide all or a substantial part of the heat required in the mixing zone. However, where the aggregate is heated by a burner flame, the substantially flame-free combustion gases from the heating zone can be made to pass through the mixing zone to heat the material being mixed.

In one embodiment, the heating zone may be suitably inclined so that aggregate will pass generally downwardly through the heating zone to be heated and leave it from a bottom region thereof. The hot aggregate can then be allowed to fall into the mixing zone. The combustion gases for heating the aggregate can also be made to flow generally downwardly through the heating zone and can be guided downwardly into the mixing zone together with the hot aggregate. The aggregate and combustion gases can then be made to move downwardly through the mixing zone to heat the materials therein. For this purpose, an extractor fan may be used for drawing the combustion gases through the mixing zone.

The heating and mixing zones may each be provided by a respective drum, each such drum being rotatable about a respective axis and having formations, such as helical flights, on its inner surface for inducing aggregate or materials being mixed, as the case may be, to move through the drums. The provision of the flights can enable the retention time of the aggregate and materials in the drums to be adjusted by controlling the rotational speed of each drum.

It may also be possible for the retention time of aggregate or materials being mixed to be adjusted by varying the angle of tilt of each drum. The tilt of the drums may be adjusted together or independently.

The present invention also extends to a plant for recycling asphalt, the plant comprising a heating drum about an axis and provided with a burner for heating aggregate; means for controlling heating of said aggregate by said burner; and a burnerless mixing drum rotatable about an axis for receiving heated aggregate from the heating drum, and means for supplying reclaimed asphalt and binder material to said mixing drum for mixing with heated aggregate from the heating drum.

The means for controlling heating of the aggregate may comprise fuel control means for controlling the supply of combustible material to the burner. Additionally or alternatively, the controlling means may comprise retention control means for controlling the mean retention time of aggregate in the heating drum.

In one form, a suitable retention control means may comprise, in combination, formations provided on the interior of the heating drum for feeding aggregate along the drum and a variable speed motor for enabling the rotational speed of the drum to be varied so that the rate of feed of aggregate and thus the retention time of aggregate in the drum can be varied. In another form, the retention control means may comprise means for tilting the drum so that aggregate will pass more or less rapidly through the drum.

The mixing drum may also be provided with means for controlling the mean retention time of material therein, and this may be similar to that provided for the heating drum.

In a preferred embodiment, the heating drum and mixing drum are both tilted so that aggregate can pass downwardly through the heating drum, fall into the mixing drum, and then pass downwardly through the mixing drum where it is mixed with reclaimed asphalt and binder material. The burner for heating the aggregate may be provided towards the upper end of the heating drum so that combustion gases will pass downwardly through the heating drum. Means may be provided for guiding the combustion gases together with the aggregate from the heating drum to the mixing drum. In addition, an extractor fan may be provided for drawing the combustion gases through the mixing drum.

The present invention also extends to recycled asphalt produced by the method or in a plant according to the invention.

An embodiment of the invention will now be described, by way of example, with reference to the accompanying drawings, in which FIG. 1 is a side view of an asphalt recycling plant according to the invention;

Figure 1:
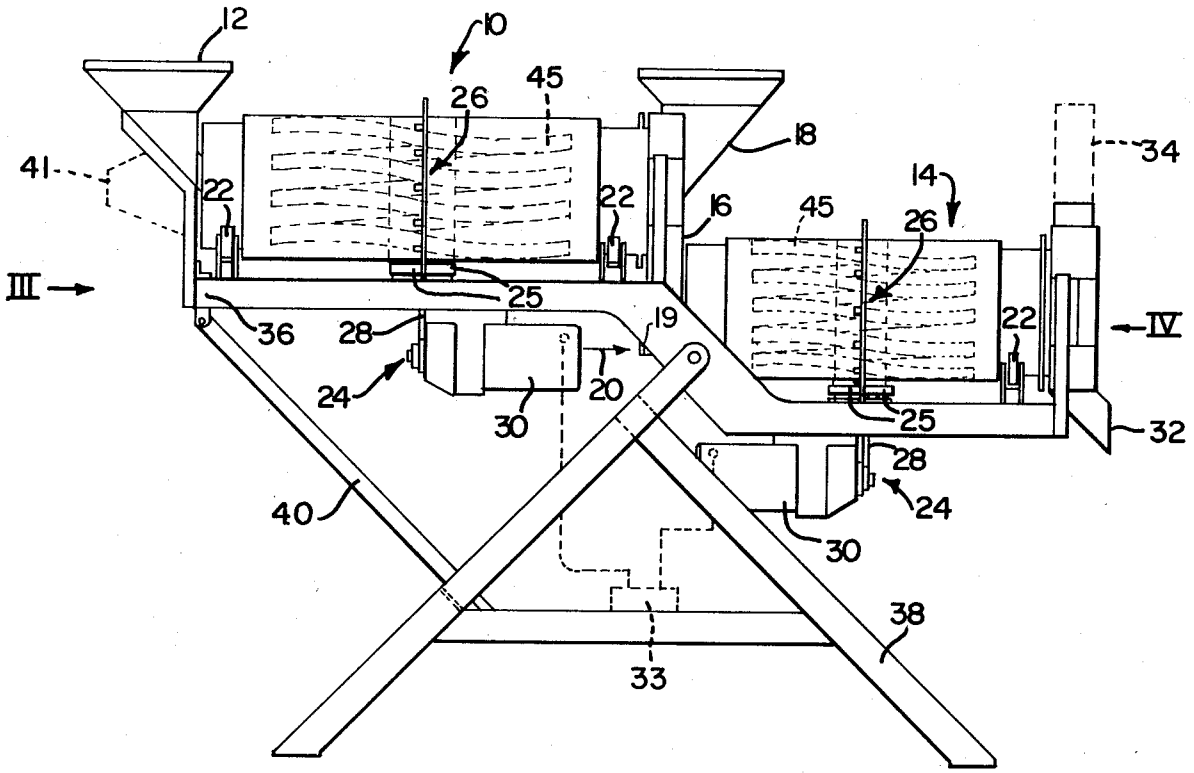
Figure 2:
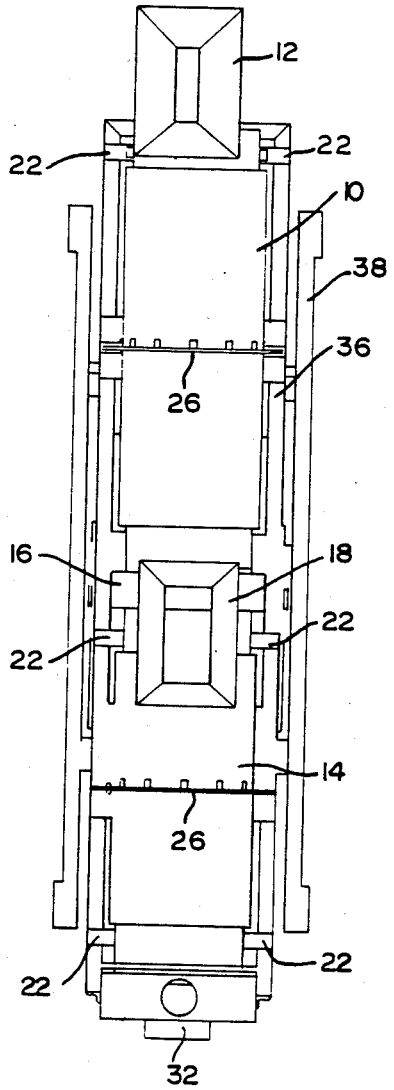
FIG. 2 is a plan view of the plant of FIG. 1.
Figure 3:
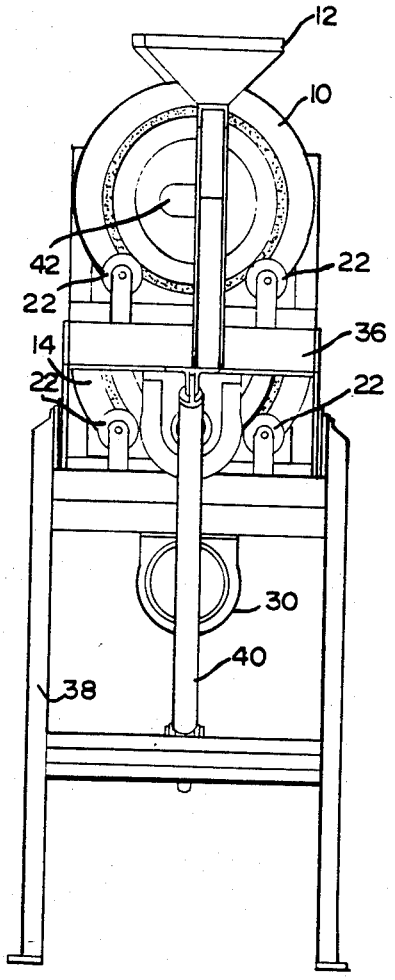
FIG. 3 is an end view of the plant in the direction of arrow III in FIG. 1.
Figure 4:
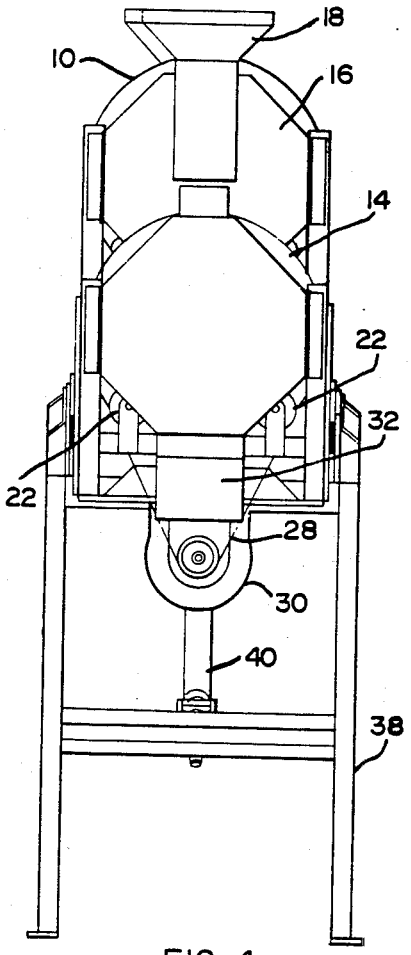
FIG. 4 is an end view of the plant in the direction of arrow IV in FIG. 1.

The plant shown comprises a heating drum 10 which also serves as a drying drum for heating and drying new aggregate, which can be supplied into the drum by way of a suitable hopper 12. Aggregate can be supplied into the hopper by a conveyor or in any other suitable manner. The plant also includes a mixing drum 14 for mixing hot aggregate from the heating drum with reclaimed asphalt and suitable new binder material. The mixing drum also serves as a heat exchange drum. The aggregate from the drum 10 can be supplied to the drum 14 by way of a guide chute 16 extending downwardly from one end of the drum 10 to the other end of the drum 14 which is at a lower level than drum 10. A further hopper 18 is provided for supplying reclaimed asphalt into the chute 16 so that it passes with the aggregate from the drum 10 in the drum 14. In addition, binder material can be introduced into the drum 14 by a trickle feed means 19 in the direction of arrow 20.

Each of the drums is rotatable about a respective axis on rollers 22 and axial movement of each drum is restricted by rollers 25. Each drum can be rotated as required by a respective variable speed drive 24 the drives 24 being controllable by speed control means 33. Each drive 24 comprises a toothed ring 26 encircling the respective drum and engaged by rollers 25 to locate the drum, a drive chain 28 engaging the respective ring, and a variable speed electric motor 30 for driving the chain to drive the drum.

An outlet chute 32 is provided at the opposite end of the drum 10 to the chute 16, and is associated with a hot gas extractor 34 capable of drawing gases through the drum 10, chute 16 and drum 14 and then exhausting gases to atmosphere.

The drums, hoppers and chutes are mounted on a frame 36 which is itself mounted on an A-frame 38, the angle of tilt of the frame 36 being variable by means of an extensible rod 40 connected to the frame 36 and the frame 38. The degree to which the rod 40 is extended enables the frame, and thus the axes of the drums 10 and 14, to be inclined as required.

A gas burner 41 is fitted into an opening 42 of a cover at one end of the drum 10 for supplying combustible fuel into the drum 10. However, the drum 14 is not provided with a burner.

In operation, the rod 40 is extended so that the axes of the drums 10 and 14 are tilted downwardly towards the chute 32. Combustible fuel is then burnt by means of the burner provided at the opening 42 so that the fuel burns in the drum close to the opening, and aggregate is introduced into the drum 10 by way of the hopper 12. The burning fuel is used to heat the aggregate to such a temperature that the heated aggregate and combustion gases flowing through the drum will provide sufficient heat for the complete recycling process.

The drums 10 and 14 are rotated at speeds which are suitably related to the angle of tilt of the drums to ensure that the retention time of material in each drum is adequate. The drum 10 may include L-shaped spiral flights 45 for lifting the aggregate and dropping it through combustion gases within the drum, and for feeding the aggregate towards the chute 16.

On reaching the chute 16, the hot aggregate falls into the chute and reclaimed asphalt, which has been milled so that it is of a suitable size, is also fed into the chute from the hopper 18. The aggregate and reclaimed asphalt together with a binder introduced in the direction of arrow 20, thus pass into the drum 14 together with combustion gases which also pass from the drum 10 to the drum 14 through the chute 16. Once the materials are in the drum 14 they are mixed and for this purpose the drum 14 may be provided with spiral flights on its inner surface to improve mixing. The flights 45 can also serve to feed the material being mixed towards the chute 32. The heat from the combustion gases flowing through the drum 14 and from the aggregate, provide sufficient heat to ensure that the final mix is at a suitable temperature for handling and for laying a pavement.

As the mixer drum is not provided with a burner but relies for its heat input on the heat from the hot aggregate and the combustion gases from the heater drum, flame damage to the new binder and the reclaimed asphalt can be avoided.

In order to ensure that combustion gases from the drum 10 pass through the chute 16 and into the drum 14, the hot gas extractor may be used to draw the combustion gases through the drums and the chute 16.

It will be clear that, in order to control the recycling process and to ensure that the final temperature of the mixture from the drum 14 is correct, the rotational speeds of the drums and the angles of tilt of the drums can be adjusted independently by means 33 and 41, respectively to control the retention times of materials in the drums, and the supply of heat to the drum 10 can also be varied by the fuel feed rate to the burner.

Figure 5:
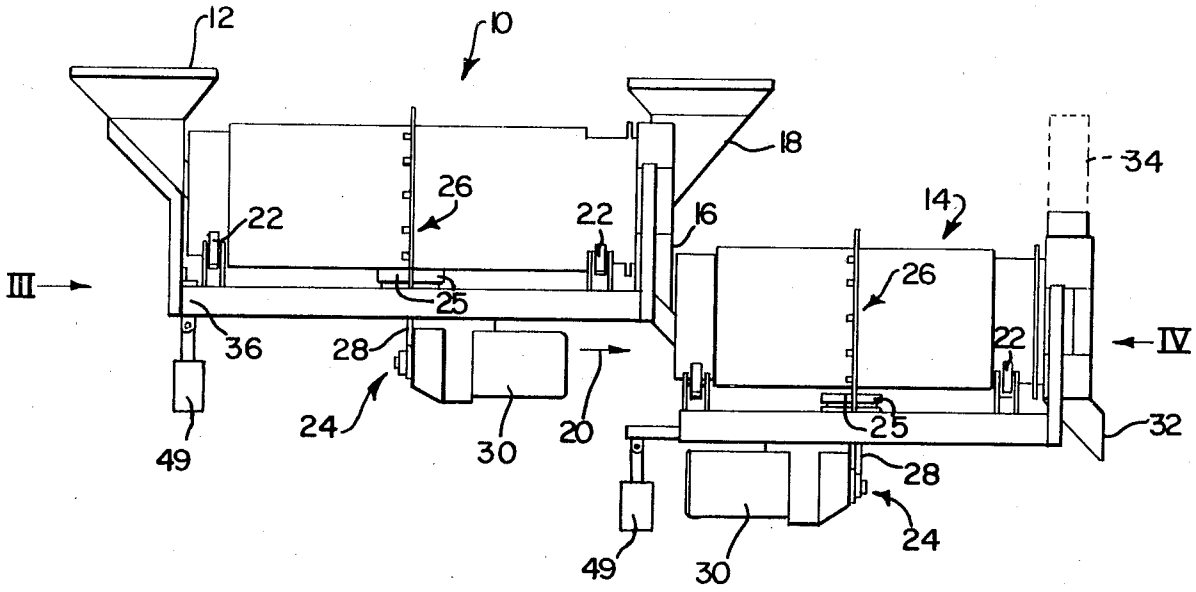
FIG. 5 shows features of an alternative asphalt recycling plant herein described.

Although the drums 10 and 14 are shown in FIGS. 1 to 4 on a single frame so that their angles of tilt are adjusted together, it is possible to allow for the angles of tilt of the drums to be adjusted independently for example by means 49 as shown in FIG. 5.

The recycling plant shown forms a relatively compact integrated unit which, with the necessary materials feed systems, can form part of a portable or mobile plant, possibly on a wheeled chassis, enabling it to be taken to a construction site, so saving the cost of transporting reclaimed pavement material. It is anticipated that mobile plants having a material-handling capacity of, for example, at least 20 tonnes per hour, could be made in a satisfactory manner.

I claim:

1. A method of recycling asphalt, which comprises heating aggregate in a rotating heating zone by a burner flame, supplying the heated aggregate to and introducing reclaimed asphalt and suitable binder material into a rotating, separately rotatable flame-free mixing zone, and there mixing these constituents to produce a usable hot asphalt pavement mix wherein the heated aggregate and flame-free combustion gases from the heated zone pass through the mixing zone also to heat the reclaimed asphalt.

2. A method according to claim 1, wherein the heating zone is inclined for causing aggregate to pass generally downwardly through the heating zone to be heated and to leave it from a bottom region thereof, and wherein combustion gases for heating the aggregate also flow generally downwardly through the heating zone and are guided downwardly into the mixing zone together with the hot aggregate.

3. A method according to claim 2, wherein the aggregate and combustion gases are made to move downwardly through the mixing zone to heat the materials therein.

4. A plant for recycling asphalt, the plant comprising a heating drum rotatable about an axis and provided with a burner at the upper end of the heating drum for heating aggregate, means for controlling heating of said aggregate by said burner; and a separately rotatable burnerless mixing drum rotatable about a second axis for recovering heated aggregate from the heating drum and which is positioned at a lower level than the heating drum; and means for supplying reclaimed asphalt and binder material to said mixing drum for mixing with the heated aggregate from the heating drum, wherein the tilt of the heating drum and mixing zone are independently adjustable at downwardly inclined angles, and there is provided a chute so that aggregate can pass downwardly through the heating drum, fall via the chute into the mixing drum, and then pass downwardly through the mixing drum to mix with reclaimed asphalt and binder material.

5. The plant of claim 4, including means for guiding the combustion gases together with the aggregate from the heating drum to the mixing drum.

6. The plant of claim 5, including an extractor for drawing the combustion gases through the mixing drum.

7. A method of producing a hot asphalt pavement mix using recycled asphalt pavement, comprising the steps of feeding new aggregate into one end of a rotatable heating drum, tilting the heating drum so that the axis of rotation of the heating drum is inclined downward from the one end of the heating drum, rotating the heating drum to feed the aggregate downwardly from the one end of the heating drum to its other end, heating the aggregate by a burner flame in the heating drum, dropping the heated aggregate from the other end of the heating drum via a chute into one end of a burnerless rotatable mixing drum which is positioned at a lower level from the heating drum, also feeding recycle asphalt pavement via a hopper and the chute into one end of the mixing drum, further feeding a suitable binder material into the mixing drum, tilting the mixing drum so that the axis of rotation of the mixing drum is inclined downwardly from the one end of the mixing drum, rotating the mixing drum to mix the heated aggregate, recycle asphalt and binder material and to feed the mixture downwardly from the one end of the mixing drum to its other end, drawing combustion product gases from the heating drum through the chute and through the mixing drum, said rotating and tilting of the mixing drum being selected independent of the heating drum to provide suitable mixing and feeding of the heated aggregate, recycle asphalt and binder material through the mixing drum, and said rotating and tilting of the heating drum being selected independent of the mixing drum to provide adequate retention time of the aggregate in the heating drum to provide suitable heating of the aggregate to produce hot asphalt pavement mix from the other end of the mixing drum.

8. A plant for producing a hot asphalt pavement mix using recycled asphalt pavement, comprising a rotatable heating drum, means for feeding new aggregate into one end of the rotatable heating drum, means for tilting the heating drum so that the axis of rotation of the heating drum is inclined downward from the one end of the heating drum, means for rotating the heating drum to feed the aggregate downwardly from the one end of the heating drum to its other end, a burner for producing a flame in the heating drum to heat the aggregate therein, a burnerless rotatable mixing drum which is positioned at a lower level from the heating drum, a chute for directing heated aggregate falling from the other end of the heating drum into one end of the mixing drum, a hopper for feeding recycle asphalt pavement into the chute and into one end of the mixing drum, means for feeding a suitable binder material into the mixing drum, means for tilting the mixing drum so that the axis of rotation of the mixing drum is inclined downward from the one end of the mixing drum, means for rotating the mixing drum to mix the heated aggregate, recycle asphalt and binder material and to feed the mixture downwardly from the one end of the mixing drum to its other end, means for drawing combustion product gases from the heating drum through the chute and through the mixing drum, said rotating means and said tilting means for the mixing drum being selected independently of the heating drum to provide suitable mixing and feeding of the heated aggregate, recycle asphalt and binder material through the mixing drum, and said rotating means for the heating drum being selected independent of the mixing drum to provide adequate retention time of the aggregate in the heating drum to provide suitable heating of the aggregate to produce hot asphalt pavement mix at the other end of the mixing drum.

* * * * *